US011203997B2

(12) United States Patent
Kleineberg et al.

(10) Patent No.: US 11,203,997 B2
(45) Date of Patent: Dec. 21, 2021

(54) TOLERANCE AND WEAR COMPENSATION OF A FUEL PUMP

(71) Applicant: Vitesco Technologies GmbH, Hannover (DE)

(72) Inventors: Stefan Kleineberg, Schwalbach a. Ts. (DE); Mariz Abdelmalek, Schwalbach a. Ts. (DE); Marc Völker, Schwalbach a. Ts. (DE); Andreas Sausner, Schwalbach a. Ts. (DE)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 16/767,550

(22) PCT Filed: Nov. 1, 2018

(86) PCT No.: PCT/EP2018/079936
§ 371 (c)(1),
(2) Date: May 27, 2020

(87) PCT Pub. No.: WO2019/105677
PCT Pub. Date: Jun. 6, 2019

(65) Prior Publication Data

US 2020/0370498 A1 Nov. 26, 2020

(30) Foreign Application Priority Data

Nov. 28, 2017 (DE) ..... 10 2017 221 342.6

(51) Int. Cl.
*F02D 41/30* (2006.01)
*F02M 37/18* (2006.01)
(Continued)

(52) U.S. Cl.
CPC ..... *F02D 41/3082* (2013.01); *F02D 41/248* (2013.01); *F02D 41/2432* (2013.01);
(Continued)

(58) Field of Classification Search
None
See application file for complete search history.

(56) References Cited

U.S. PATENT DOCUMENTS 6,715,470 B2 * 4/2004 Takahashi ..... F02D 41/221 123/458
9,528,519 B2 * 12/2016 Sausner ..... F02D 41/221
(Continued)

FOREIGN PATENT DOCUMENTS

DE 10 2006 060 754 6/2008
DE 10 2007 062 215 6/2009
(Continued)

OTHER PUBLICATIONS

International Search Report issued in corresponding PCT Application PCT/EP2018/079936.
(Continued)

*Primary Examiner* — Kevin R Steckbauer
(74) *Attorney, Agent, or Firm* — Cozen O'Connor

(57) ABSTRACT

A method for calibrating a fuel pump for use in a fuel supply system of a device having internal combustion engine includes determining a tolerance-conditioned and wear-conditioned deviation of the fuel pump with respect to its delivery behavior so that the calibration permits energy-consumption-optimized actuation of the fuel pump.

20 Claims, 3 Drawing Sheets

(51) Int. Cl.

| | |
|---|---|
| ***F02D 41/24*** | (2006.01) |
| ***F02D 41/38*** | (2006.01) |
| *F02D 41/22* | (2006.01) |
| *F02M 37/08* | (2006.01) |
| *F04D 15/00* | (2006.01) |

(52) U.S. Cl.
CPC ..... *F02D 41/2438* (2013.01); *F02D 41/2464* (2013.01); *F02D 41/3836* (2013.01); *F02M 37/18* (2013.01); *F02D 41/2441* (2013.01); *F02D 2041/224* (2013.01); *F02D 2200/0602* (2013.01); *F02M 37/08* (2013.01); *F04D 15/0066* (2013.01)

(56) References Cited

U.S. PATENT DOCUMENTS

| | | | | |
|---|---|---|---|---|
| 9,732,694 | B2 * | 8/2017 | Mori | F02M 37/08 |
| 10,221,801 | B2 * | 3/2019 | Sausner | F02D 41/3082 |
| 10,253,718 | B2 * | 4/2019 | Grime | F02M 37/18 |
| 2003/0127082 | A1 * | 7/2003 | Takahashi | F02D 41/3845 123/704 |
| 2012/0156057 | A1 * | 6/2012 | Akita | F02D 41/3082 417/44.2 |
| 2014/0105758 | A1 * | 4/2014 | Sausner | F02D 41/221 417/44.11 |
| 2015/0275812 | A1 * | 10/2015 | Mori | F02D 33/003 123/497 |
| 2017/0037808 | A1 * | 2/2017 | Sausner | F02D 41/2464 |
| 2018/0142642 | A1 * | 5/2018 | Grime | F02D 41/3082 |
| 2020/0370498 | A1 * | 11/2020 | Kleineberg | F02D 41/2432 |
| 2020/0386183 | A1 * | 12/2020 | Kleineberg | F02D 41/248 |

FOREIGN PATENT DOCUMENTS

| | | |
|---|---|---|
| DE | 10 2010 064 176 | 6/2012 |
| DE | 10 2011 005 663 | 9/2012 |
| DE | 11 2013 004 970 | 8/2015 |
| DE | 10 2014 222 335 | 5/2016 |
| DE | 10 2014 222 390 | 5/2016 |
| DE | 10 2014 224 261 | 6/2016 |
| DE | 10 2016 200 715 | 7/2017 |
| DE | 2016 201 186 | 7/2017 |

OTHER PUBLICATIONS

Written Opinion issued in corresponding PCT Application PCT/EP2018/079936.
Office Action issued in corresponding German Application No. 10 2017 221 342.6.

* cited by examiner

TOLERANCE AND WEAR COMPENSATION OF A FUEL PUMP

CROSS REFERENCE TO RELATED APPLICATIONS

This is a U.S. national stage of International application No. PCT/EP2018/079936, filed on Nov. 1, 2018, which claims priority to German Application No. 10 2017 221 342.6, filed Nov. 28, 2017, the content of each of which is incorporated herein by reference.

BACKGROUND OF THE INVENTION

1. Field of the Invention

The invention relates to a method for determining a component tolerance and a state of wear of a fuel pump provided for a fuel supply system for use in a device equipped with an internal combustion engine. The invention also relates to a method for calibrating such a fuel pump.

2. Description of the Prior Art

Devices or systems in this regard are any type of device or system equipped with an internal combustion engine and supplied with a liquid fuel for operation, these being in particular passenger cars and/or utility vehicles but also stationary or mobile power generators. A liquid fuel is understood here to be, in particular, a gasoline fuel or diesel fuel or else an alternative liquid combustible fuel.

An internal combustion engine is supplied with a fuel as a function of the operating point in accordance with a fuel consumption demand of a fuel pump arranged e.g., in a fuel tank. For cost reasons, the delivery of fuel by the fuel pump is implemented here solely under open-loop control and not subject to any setpoint/actual value comparisons that are characteristic of closed-loop control. Open-loop controlled delivery fuel is subject to a certain degree of inaccuracy, caused, on one hand, by production-related component tolerance of the fuel pump and, on the other hand, by wear of the fuel pump. Such natural wear occurs, in particular, with what is referred to as a positive displacement pump—i.e., a pump which operates according to what is referred to as the positive displacement principle—and occurs increasingly over its service life so that a deviation between a delivery quantity which actually occurs and a set delivery quantity of the fuel pump becomes increasingly pronounced over its service life. The component tolerance of the fuel pump is in turn dependent on wear so that it changes over the service life of the fuel pump. This is also referred to as involving a tolerance situation of the fuel pump, which changes over the service life of the fuel pump as a function of the wear.

Both the component tolerance and the state of wear of the fuel pump have until now not been allowed for in a fuel supply system having solely open-loop control. It is also the case that a development of wear of the fuel pump cannot be reliably predicted. Therefore, the inaccuracy of the delivery of fuel mentioned above is counteracted by allowing the fuel pump to deliver more from the beginning than is actually required in respect of the fuel requirement of the internal combustion engine, so that toward the end of its service life a worn fuel pump actually satisfies the requirements made of it. However, this requires increased energy consumption of the fuel pump.

SUMMARY OF THE INVENTION

An object on which the invention is based is therefore to make available more accurate delivery of fuel. A further object of the invention is to reduce the energy consumption of such a fuel pump and therefore to contribute to an improved $CO_2$ balance of a device operated with an internal combustion engine.

These objects may be achieved by the two methods set forth below.

The first method determines an inflection point, representative of a component tolerance and a state of wear of a fuel pump, of a parameter profile. The method comprises the following steps:

- under defined conditions, at least partial or complete active shutting off of a fuel-conducting point of a feed line of the fuel supply system downstream of the fuel pump, to at least reduce or even completely prevent a flow of fuel to an internal combustion engine, and
- incrementally increasing a rotational speed n of a fuel pump motor in order to increase the pressure upstream of the shut-off point while simultaneously determining a phase current i that occurs in the fuel pump motor, wherein the rotational speed is increased until a valve of the fuel supply system opens (OP=opening point) to reduce the pressure, wherein the individual rotational speed stages are assigned a determined value for the phase current i, and
- approximating a first set of value pairs of, in each case a phase current i and an assigned rotational speed n below the inflection point (OP) by a first straight line, approximating a second set of value pairs of in each case a phase current i and an assigned rotational speed n above the inflection point (OP) by a second straight line, and determining an intersection point between the two straight lines, wherein the intersection point corresponds to the inflection point (OP) which corresponds to the opening time (OP) of the valve, wherein a rotational speed $n_{OP}$ is assigned to the intersection point.

The phase current i—which can be a direct current or an alternating current—is proportional to the pressure p generated in the fuel pump, and in a first approximation proportional to the pressure p upstream of the shut-off point.

This proportionality constitutes a system property which can be determined.

A partial or complete shut-off of the fuel-conducting point is to be understood here as meaning a partial constriction or a complete closing off of the fuel-conducting point by a shut-off device. The shut-off device can be, for example, a separate, actively actuable valve or a high-pressure pump, which, as such, has a low-pressure-side inlet and a high-pressure-side outlet, which each function as such a valve.

The first method constitutes a cost-effective and efficient solution for determining an inflection point, representative of a component tolerance and a state of wear of a fuel pump, of a parameter profile. As will also be shown below, the first method contributes to compensating for the inaccuracy, mentioned in the introduction, of the delivery of fuel solely under open-loop control. This in turn contributes to a saving in energy in conjunction with the actuation of the fuel pump motor and therefore also to an improved $CO_2$ balance of a device which is equipped with an internal combustion engine.

The second method is aimed at calibrating a fuel pump using the first method described above. The second method comprises the following steps:

under defined conditions, at least partial or complete active shutting off of a fuel-conducting point of a feed line of the fuel supply system downstream of the fuel pump, to at least reduce or even completely prevent a flow of fuel to an internal combustion engine, to determine an inflection point of a parameter profile representative of a component tolerance and a state of wear of the fuel pump, by incrementally increasing a rotational speed n of the fuel pump motor to increase the pressure upstream of the shut-off point while simultaneously determining a phase current i that occurs in the fuel pump motor, wherein the rotational speed is increased until a valve of the fuel supply system opens (OP=opening point) to reduce the pressure, wherein the individual rotational speed stages are assigned a determined value for the phase current i, and by approximating a first set of value pairs of in each case a phase current i and an assigned rotational speed n below the inflection point (OP) by a first straight line, approximating a second set of value pairs of in each case a phase current i and an assigned rotational speed n above the inflection point (OP) by a second straight line, and determining an intersection point between the two straight lines, wherein the intersection point corresponds to the inflection point (OP) corresponds to the opening time (OP) of the valve, wherein a rotational speed $n_{OP}$ is assigned to the intersection point.

To perform calibration, there is determined at a first time ($t_1$), a first inflection point ($OP_n$) as a reference point or initial point for a non-worn fuel pump and at a second, later time ($t_2$), a second inflection point ($OP_v$) corresponding to the current state of wear of the fuel pump.

Subsequently, a rotational speed difference Δn is determined between the first inflection point ($OP_n$) and the second inflection point ($OP_v$), wherein, for energy-consumption-optimized actuation of the fuel pump up to the next calibration process to be carried out, the rotational speed difference Δn is added as a fixed value to a rotational speed of the fuel pump, which can be determined as a function of the requirement of the engine.

Calibration in the sense of the present disclosure is to be understood as meaning determination of a deviation of the fuel pump in respect of its delivery behavior that can be attributed to a component tolerance and a state of wear of the fuel pump, wherein the actually determined deviation is taken into account at the subsequent actuation of the fuel pump to compensate for the inaccuracy of the fuel pump.

The inaccuracy of the open-controlled delivery of fuel, mentioned in the introduction, is compensated for by the proposed second method or calibration method without at the same time having to intervene with sensor-based acquisition of actual values for closed-loop control. In this respect, this calibration method also constitutes a cost-effective solution, in particular in conjunction with a concept without pressure sensors. Such a concept without pressure sensors is to be understood as meaning a fuel supply system whose low-pressure part does not have a pressure sensor installed as hardware. Such compensation of the inaccuracy in turn contributes to a saving in energy in conjunction with the actuation of the fuel pump motor and therefore also contributes to an improved $CO_2$ balance of a device that is equipped with an internal combustion engine.

According to one aspect of the invention, the rotational speed difference is only used, starting from a defined minimum value, which can be determined, for calibrating the fuel pump. Therefore, rotational speed differences below this minimum value can be ignored.

According to a further aspect of the invention, the first and second methods are carried out during an overrun mode of the internal combustion engine or during an operating phase of the internal combustion engine under at least approximately constant conditions.

An overrun mode of the internal combustion engine is to be understood as meaning a temporary interruption of a fuel supply to the internal combustion engine when the internal combustion engine is not to output any power and instead is to be entrained by a vehicle mass which is in motion, or by a centrifugal mass is mechanically coupled to the crankshaft of the internal combustion engine.

An operating phase of the internal combustion engine under at least approximately constant conditions would be, e.g., n idling phase in which the internal combustion engine does not output any significant torque via the crankshaft. However, an operating phase under at least approximately constant load conditions, under which the internal combustion engine outputs a corresponding torque via the crankshaft, would be equally conceivable.

According to a further aspect of the invention, the first and second methods are carried out at regular intervals in order to update the determination of the inflection point, representative of the component tolerance and the state of wear of the fuel pump, of the parameter profile (i, n), on the one hand, and the calibration of the fuel pump, on the other, over its service life.

According to an aspect of the invention, the first and second methods are carried out after a definable operating time or number of operating hours of the device or a definable kilometrage status of the vehicle. In this context, the first method for determining the reference point or initial point can first be carried out after a first operating time of e.g. 1 to 3 hours (h) or a kilometrage status of e.g. 20 to 100 km, after which the fuel pump is still not worn. After this, the first and second methods can be carried out at intervals which each correspond to a multiple of the first operating time or of the first kilometrage status, approximately every 10 to 100 hours (h) or every 500 to 1000 km. The intervals that follow the first number of operating hours or kilometrage status do not have to be constant. In this way, these intervals can, e.g., be shortened and/or also lengthened over the service life of the fuel pump. Additionally or alternatively, the two methods can, e.g., also be carried out after a definable number of driving cycles of the vehicle, for which corresponding intervals can be defined in an analogous fashion. Such a driving cycle is to be understood as meaning a cycle defined by the process of switching on followed by the process of switching off an ignition system. Additionally or alternatively, the two methods can also be carried out after a refueling process of a fuel tank. As result, the influence on the two methods of fuel quality which has changed in the interim can be compensated for.

In conjunction with the incremental increasing of the rotational speed n of the fuel pump motor described above, it is proposed to increase the rotational speed n at least essentially in the form of a rotational speed ramp. However, a progressive or degressive actuation profile is, in principle, also suitable for the incremental increasing of the rotational speed n.

The rotational speed n assigned to the respective inflection point is stored in non-volatile fashion in a memory of a control unit for system-side use. The determined rotational speed difference can equally also be stored in non-volatile fashion in the memory of the control unit for system-side use.

Furthermore, a computer program and a computer program product for carrying out the first and second methods are proposed, wherein the computer program and the computer program product model these two methods by software.

The computer program and the computer program product can each be understood in terms of a function module architecture, wherein such function module architecture has at least one function block so that the computer program and the computer program product are each equivalent to a device which has at least one structure for carrying out the first and second methods. In this context, the at least one structure of the device corresponds to the specified at least one function block.

In addition, a fuel supply system for use in a device or system equipped with an internal combustion engine is proposed, wherein the first and second methods are implemented by means of software in the fuel supply system.

According to an aspect of the invention, the fuel supply system comprises a low-pressure part with a fuel pump driven by an electric motor, for delivering fuel from a fuel tank, a shut-off unit for at least partial or complete, active shutting off of a fuel-connecting point in a feed line of the fuel supply system downstream of the fuel pump, in order, under defined conditions, to at least reduce or even completely prevent a flow of fuel to an internal combustion engine, and at least one control unit in which the first and second methods are modeled or implemented by software. The low-pressure part comprises a valve for reducing pressure in a case of overpressure.

According to one aspect of the invention, the fuel supply system can have not only the low-pressure part but also a high-pressure part that has a fluidic communication connection to the low-pressure part.

According to a further aspect of the invention, the fuel supply system can comprise a high-pressure pump, which connects the low-pressure part to the high-pressure part and forms the shut-off unit in the process.

According to a further aspect of the invention, the fuel supply system can have not only an engine control unit but also a pump control unit which has a communication connection to the engine control unit and in which the first and second methods are modeled or implemented by software.

The low pressure part can be configured such that in the non-shut-off state of the fuel-conducting point a fuel pressure of up to approximately 3.5 bar can be achieved in the low-pressure part by the fuel pump, while in the at least partially or completely shut-off state of the fuel-connecting point a fuel pressure of up to approximately 3.9 bar, at which a valve opens in order to reduce the pressure, can be achieved by the fuel pump. The valve may be, for example, a valve of a fuel-conducting return line of the fuel supply system. Basically, such a return line is not absolutely necessary for this reduction in pressure. For this reduction in pressure it would e.g., be conceivable also to have just one valve arranged within a fuel tank and via which a fuel is fed back to the fuel tank by opening the valve.

Furthermore, it is proposed to use a fuel supply system of the type described above in the case of a device or system which is operated, in particular, with gasoline fuel or diesel fuel and which is equipped with an internal combustion engine.

In addition, a device or system is proposed which is equipped with an internal combustion engine, wherein the device or system comprises a fuel supply system of the type described above.

BRIEF DESCRIPTION OF THE DRAWINGS

The invention will be explained in detail in the following text with reference to the illustrations in the figures. Further advantageous refinements of the invention are apparent from the description below of preferred embodiments. For this purpose.

DETAILED DESCRIPTION OF THE PRESENTLY PREFERRED EMBODIMENTS

Identical features or features having an identical effect are denoted by the same reference signs throughout the figures.

Figure 1:
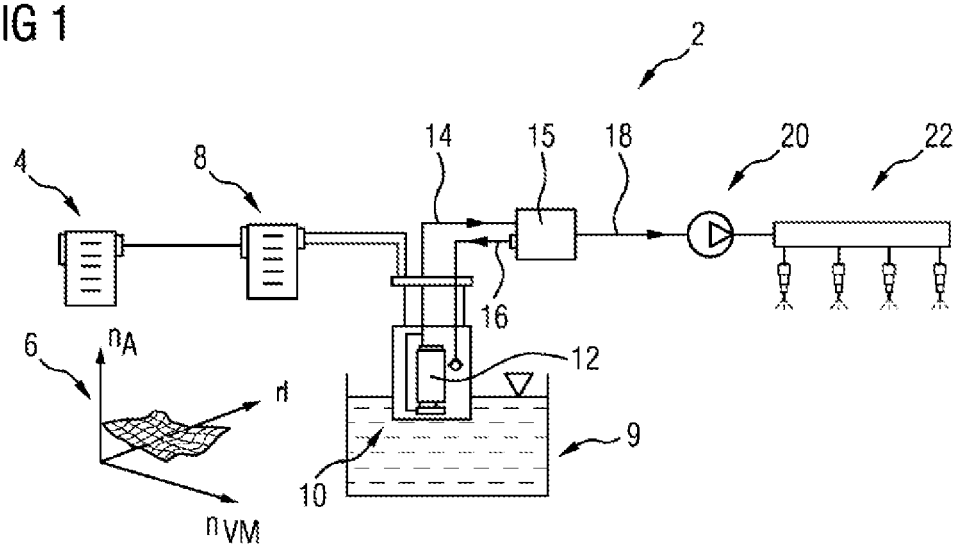
FIG. 1 shows a schematic illustration of an open-loop controlled fuel supply according to the prior art.

FIG. 1 illustrates a fuel supply system 2 with solely open-loop control, according to the prior art. An engine control unit 4 outputs a rotational speed request to a pump control unit 8 as a function of an operating point of an internal combustion engine, which pump control unit 8 has a communication connection to the engine control unit 4. The pump control unit 8 then itself actuates a fuel pump 12—also referred to as a pre-delivery pump—which is operated by an electric motor and is as such part of what is referred to as a fuel delivery unit 10. The rotational speed request $n_A$ results, e.g., from a transmission characteristic curve in the form of a three-dimensional characteristic curve 6 which can be extended, e.g., over a rotational speed $n_{VM}$ and a load rl of the internal combustion engine. However, the transmission characteristic curve could equally well also be a complex multi-dimensional transmission characteristic curve. In both cases, the transmission characteristic curve is produced by a non-worn fuel pump 12 and then used as the basis for a series application.

A fuel from a surge tank of the fuel delivery unit 10 is delivered to a fuel filter 15 via a feed line 14, and from there passes back into the surge tank from a return line 16 for excess fuel. The fuel is then delivered from the fuel filter 15 via a further feed line to a high-pressure pump 20 for further compression, which-pressure pump 20 generates in this example a high pressure for what is referred to as a common rail system ("common rail" means here "common line") 22.

Figure 2:
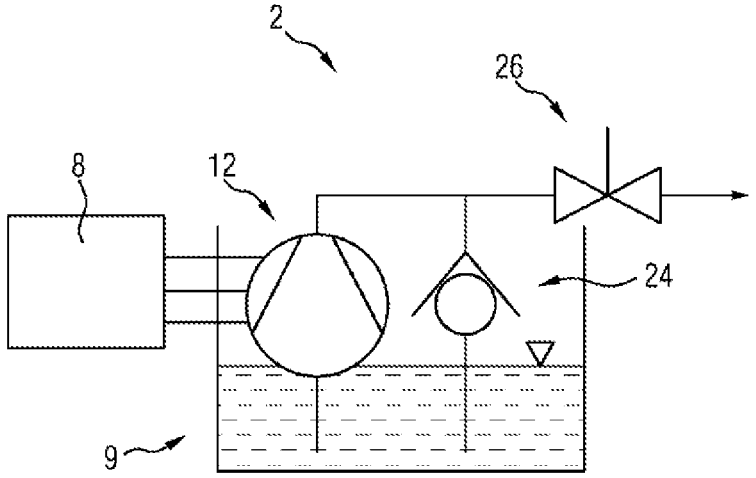
FIG. 2 shows a first schematic illustration of a proposed, open-loop-controlled fuel supply.

FIG. 2 is a highly simplified illustration of a fuel supply system 2 in which the proposed first and second methods described above are implemented or modeled by software in a pump control unit 8. The pump control unit 8 has a communication connection here to the fuel pump 12 which is operated by an electric motor and delivers a fuel from a surge tank within a fuel tank 9 to a high-pressure pump, only the low-pressure-side inlet and variable, high-pressure-side outlet 26 of which are illustrated for the sake of simplicity. In addition, an overpressure valve 24 is illustrated as part of a return line, via which excess fuel flows back into the fuel tank 9.

Figure 3:
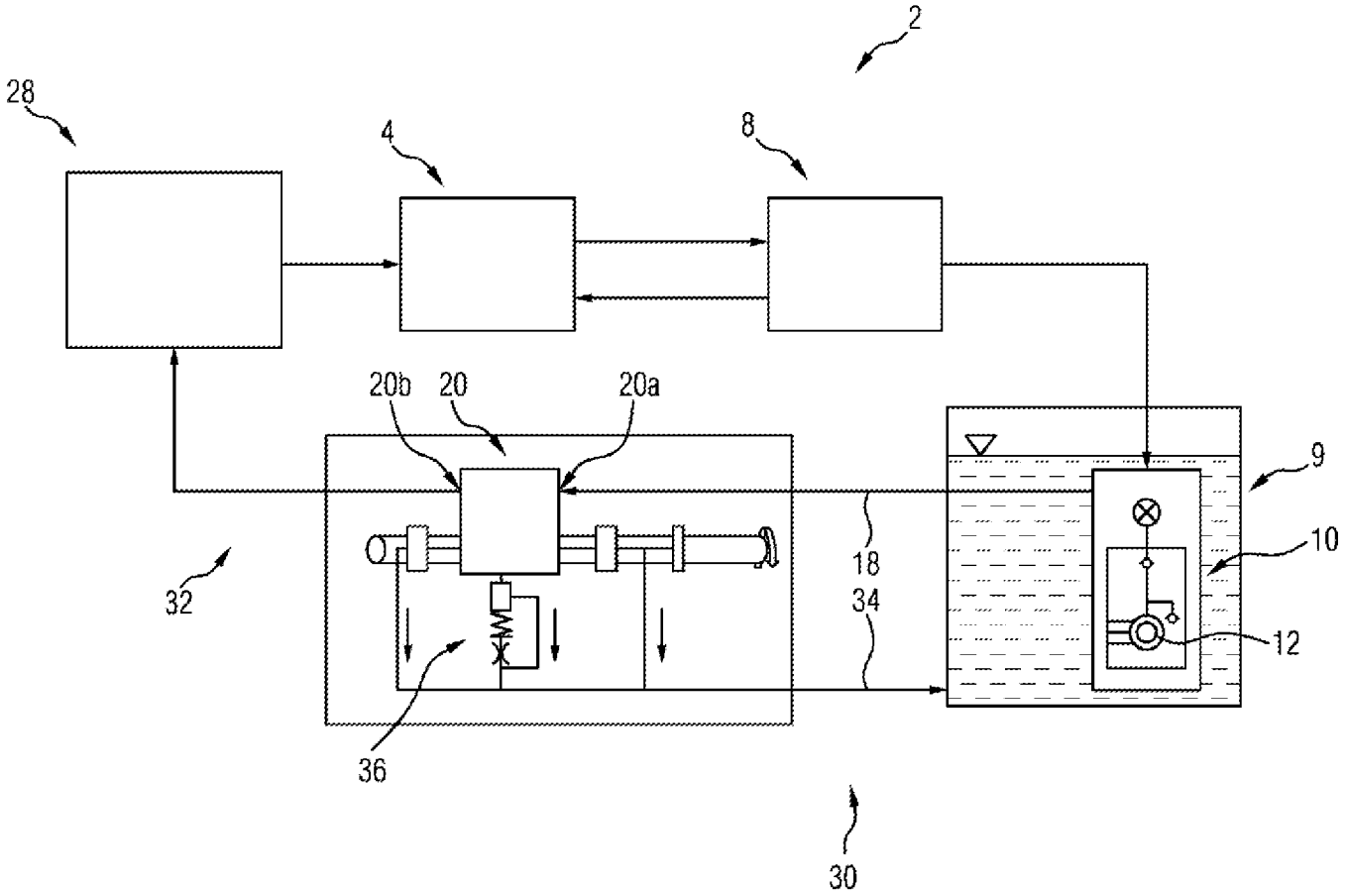
FIG. 3 shows a second schematic illustration of a proposed, open-loop-controlled fuel supply.

FIG. 3 is a further illustration of a fuel supply system 2 for supplying an internal combustion engine 28, for example in the form of a diesel engine. The fuel supply system 2 comprises here not only a low-pressure part 30 but also a high-pressure part 32 which has a fluidic communication connection to the low-pressure part 30 via a high-pressure pump 20. The high-pressure pump 20 is therefore both part of the low-pressure part 30 and part of the high-pressure part 32. The fuel supply system 2 also comprises not only an engine control unit 4 but also a pump control unit 8 which has a communication connection to the engine control unit 4 and in which the two methods described above are implemented or modeled by software. Alternatively, the two methods described above could also be modeled by software in the engine control unit 4.

The engine control unit 4 detects an operating-point-dependent fuel consumption demand of the internal combustion engine 28 and derives therefrom a rotational speed request to the pump control unit 8, which itself then actuates a fuel pump 12, operated by an electric motor, of a fuel delivery unit 10 in order to set a corresponding fuel delivery volume. in this context, the fuel pump 12 delivers, for example, a diesel fuel from a surge tank 10 which is arranged within a fuel tank 9, via a feed line 18 to the high-pressure pump 20. The fuel arrives here at the high-pressure pump 20 at a pressure of approximately 3 to 6 bar. A valve, e.g., in the form of a spring-loaded ball valve 36, which, e.g., forms part of the high-pressure pump 20, limits the admission pressure in the low-pressure part 30 to approximately 3 to 6 bar ($p_{Max}$) depending on the design. Excess fuel passes back into the fuel tank 9 via a return line 34. The high-pressure pump 20, which can be embodied, for example, in the form of what is referred to as a radial piston pump, compresses the fuel further to a pressure of up to 2500 bar, depending on the application. If the pressure in the pump space exceeds a rail pressure, an engine-side outlet valve 20*b*, 26 (FIG. 2) opens and the fuel flows through a high-pressure line of the high-pressure part 32 to a common rail (equivalent to a "common line").

According to one embodiment of the invention, the fuel supply system 2 can be configured such that in the non-shut-off state of the fuel-conducting point 26, 20*b* a fuel pressure or admission pressure pv (pv; V=admission pressure) of up to approximately 3.5 bar is achieved in the low-pressure part 30 by the fuel pump 12, while in the at least partially or completely shut-off state of the fuel-conducting point 26, 20*b* a fuel pressure up to approximately 3.9 bar, at which a valve opens (poD; CD=opening pressure), is achieved in the low-pressure part 30 by the fuel pump 12.

Figure 4:
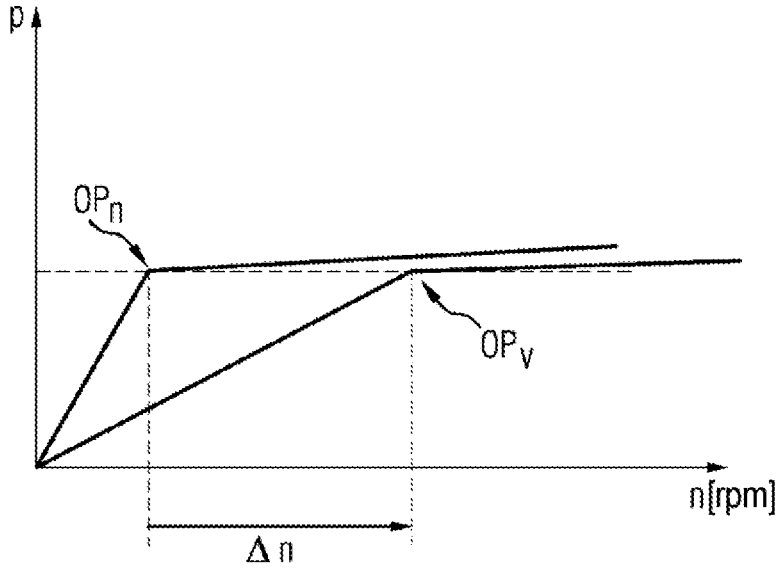
FIG. 4 shows a qualitative illustration of a parameter profile produced for a fuel pump.

FIG. 4 illustrates a correlation which comes about between a rotational speed n of the fuel pump 12 and the pressure p generated in the fuel pump 12 owing to a stepped or incremental increase in the rotational speed of the fuel pump motor. In order to increase the rotational speed in a stepped or incremental fashion, use is made here of a structure for regulating the rotational speed of the fuel pump motor, which may be embodied either as a mechanically commutated direct current motor or as an electronically commutated alternating current motor, for example in the form of a permanently excited synchronous machine. Instead of the pressure p, a phase current i of the fuel pump motor can also be plotted because the phase current i, which occurs in a load-dependent fashion in the fuel pump motor is proportional to the pressure p in the fuel pump. The phase current i, can be a direct current or an alternating current here depending on the design of the fuel pump motor. The pressure p in the fuel pump is in turn in a first approximation proportional to the pressure p upstream of the shut-off point.

To calibrate the fuel pump 12 the rotational speed n of the fuel pump 12 is increased incrementally when the high-pressure-side outlet valve 20*b* of the high-pressure pump 20 (cf. also reference sign 26 in FIG. 2) is closed. This is the case, e.g., if the internal combustion engine 28 goes into an overrun mode in which a fuel supply to the internal combustion engine 28 is temporarily interrupted and in which the internal combustion engine is not to output any power and instead is to be entrained by a vehicle mass which is in motion, or by a centrifugal mass which is mechanically coupled to the crankshaft of the internal combustion engine. According to the exemplary illustration in FIG. 5, the rotational speed n can be increased here in a stepped shape or incrementally.

Figure 5:
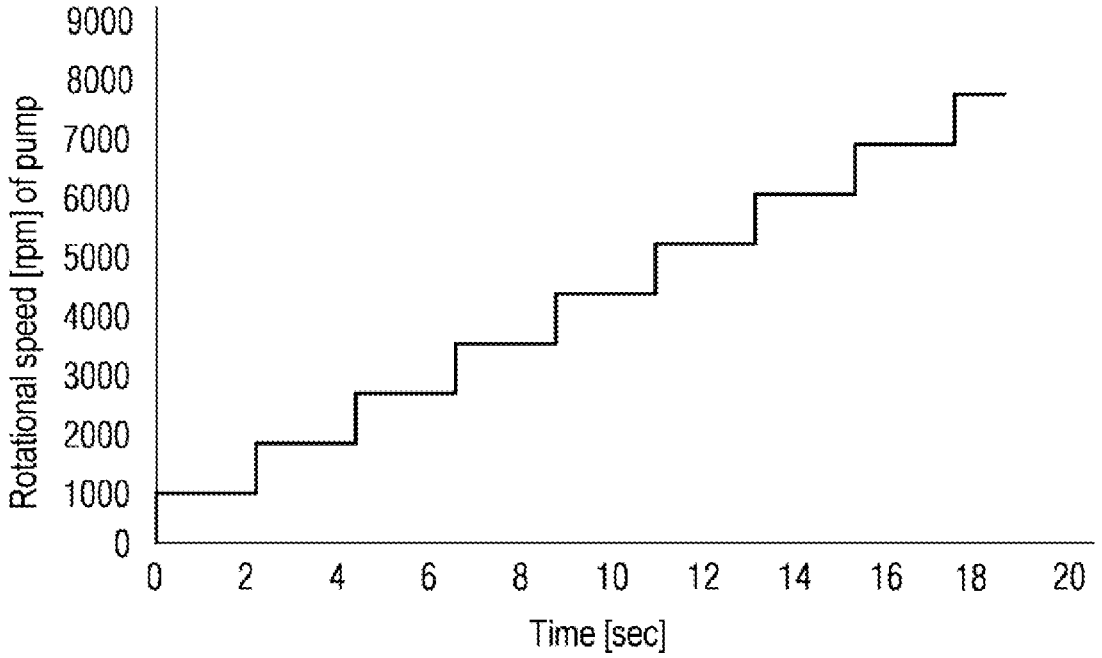
FIG. 5 shows a proposed, stepped rotational speed profile for application on the fuel pump.

FIG. 5 illustrates an increase in rotational speed in increments of a thousand (1000, 2000, 3000, . . . rpm), where the individual rotational speed increments are held for approximately 2 s. The holding time of approximately 2 s is only to be understood as exemplary here. Basically, depending on the configuration of the pump control unit 8, i.e., of the fuel pump electronics, this holding time can also assume significantly smaller values, e.g., 50 to 200 ms. A phase current i which then occurs in the fuel pump motor is then determined at each relational speed increment. Therefore, a value pair of a rotational speed n and an associated phase current i is obtained for each individual rotational speed increment.

As a result, a first set of value pairs of i and n occur below one of the respectively illustrated inflection points $OP_n$, $OP_v$ and a second set of value pairs of i and n occurs above the respectively illustrated inflection point $OP_n$, $OP_v$. A first straight line is then placed through the first set of value pairs of i and n, while a second straight line is placed through the second set of value pairs of i and n. The two straight lines intersect here at a point or intersection point which corresponds to the respective approximated inflection point $OP_n$, $OP_v$. The respective approximated inflection point $OP_n$, $OP_v$ corresponds here to the opening point (OP=Opening Point) of the valve 24, 36. In this context, the respective inflection point $OP_n$, $OP_v$ can be assigned a rotational speed $n_n$, $n_v$ in a uniquely defined fashion.

The first relatively steep parameter profile illustrates here a non-worn or new fuel pump, while the second relatively flat parameter profile illustrates a fuel pump which is already partially worn. The two parameter profiles each have an inflection point $OP_n$, $OP_v$ at which the respective sections of the straight lines meet. The two inflection points $OP_n$, $OP_v$ correspond here to an opening time of the valve 24 (FIG. 2), 36 of an assigned, fuel-conducting return line of the low-pressure part 30. The two inflection points $OP_n$, $OP_v$, which are each assigned a rotational speed $n_n$, $n_v$ (n=new, v=worn), each represent a parameter point which is representative of a component tolerance and a state of wear of the fuel pump.

To calibrate the fuel pump it is proposed here that a rotational speed difference Δn is determined between the first inflection point $n_n$ and the second inflection point $n_v$, and, for energy-consumption-optimized actuation of the fuel pump 12 up to the next calibration process to be carried out, this rotational speed difference Δn is added as a fixed value to a rotational speed of the fuel pump which can be determined as a function of the requirement of the engine.

To summarize, the steps for carrying out the proposed first and second methods are as follows:

under defined conditions, at least partial or complete active shutting off a fuel-conducting point 26, 20*b* of a feed line of the fuel supply system 2 downstream of the fuel pump 12, to at least reduce or even completely prevent a flow of fuel to an internal combustion engine 28, incrementally increasing a rotational speed n of a fuel pump motor in order to increase the pressure upstream of the shut-off point 26, 20*b* while simultaneously determining a phase current i that occurs in the fuel pump motor, wherein the rotational speed is increased until a valve 24, 36 of the fuel supply system 2 opens (OP=opening point) in order to reduce the pressure, wherein the individual rotational speed stages are assigned a determined value for the phase current i, and approximating a first set of value pairs of i and n below the inflection point (OP) by a first straight line, approximating a second set of value pairs of i and n above the inflection point (OP) by a second straight line, and determining an intersection point between the two straight lines, wherein the intersection point corresponds to the inflection point (OP) which corresponds to the opening time (OP) of the valve 24, 36, wherein a rotational speed $n_{OP}$ is assigned to the intersection point.

To calibrate the fuel pump 12 using the first method described above, the second method additionally comprises the steps:

determining a first inflection point $OP_n$ at a first time $t_1$ as a reference point for a non-worn fuel pump 12, and determining a second inflection point $OP_v$ at a second, later time $t_2$ corresponding to the current state of wear of the fuel pump 12 and subsequently, determining a rotational speed difference Δn between the first inflection point $OP_n$ and the second inflection point $OP_v$, wherein, for energy-consumption-optimized actuation of the fuel pump up to the next calibration process to be carried out, the rotational speed difference Δn is added as a fixed value to a rotational speed of the fuel pump 12, which can be determined as a function of the requirement of the engine.

The proposed calibration is a calibration carried out at regular intervals over a service life of the fuel pump 12 of a device, for example in the form of a vehicle. In this respect, the term "online calibration" can also be used. The calibration is carried out approximately regularly after a definable service life of the fuel pump—e.g., measured in operating hours (h)—or after a definable kilometrage status of the vehicle. In this context, the first method can be first carried out after a first kilometrage status of, e.g., 50 km or an operating time or number of operating hours of the fuel pump 12 of one hour to determine a reference for a new or non-worn fuel pump (reference point="initial point"). After this, the first and second methods can be repeated at regular intervals to determine a state of wear that occurs, wherein the intervals following the first interval each correspond to a multiple of the first operating time or number of operating hours or kilometrage status. For example, the second and every further kilometrage status of the vehicle could be 500 km or the second and every further number of operating hours could be 10 hours. When the first method is repeated for the first time, the second method can then also be carried out for the first time, the method having as its subject matter, in addition to the steps of the first method, the determination of the rotational speed difference Δn for the purpose of calibration. The determination of the second inflection point $OP_v$ and the calibration itself are accordingly subject to regular repetition to update the determination of the state of wear of the fuel pump over its entire service life. As a result of the fact that calibration is only carried out discontinuously, the computational expenditure of the pump control unit 8 is kept to a minimum.

A control unit in which the two methods are implemented by software is required to detect on the one hand, a necessity to carry out the two methods and, and on the other hand, to detect readiness to carry out the two methods.

Both the reference point or "initial point" and the following values of the second inflexion point $OP_v$ to be updated are stored in a non-volatile fashion in a memory of the pump control unit 8.

The inaccuracy of the open-loop-controlled delivery, mentioned in the introduction, of fuel is compensated for by the proposed second method or calibration method without at the same time having to intervene to perform closed-loop control. This in turn contributes to a saving in energy in conjunction with the actuation of the fuel pump motor and therefore also to an improved $CO_2$ balance of the vehicle.

A further embodiment may comprise a device or system in the form of a stationary or mobile power generator instead of the vehicle.

The pump control unit 8 comprises, by analogy with the engine control unit 4, a digital microprocessor unit (CPU) connected in terms of data to a storage system and a bus system, a working memory (RAM) and also a storage medium. The CPU is designed to execute commands, which are embodied as a program stored in a storage system, to detect input signals from the data bus and to output output signals to the data bus. The memory system can have at least one storage medium in the form of a solid-state magnetic element and/or another non-volatile medium in which a corresponding computer program for carrying out the method is stored. The program may be such that it embodies or is capable of executing the methods described here so that the CPU can execute the steps of such methods and therefore control the fuel pump.

A computer program having program code for carrying out all the steps of any of the method claims when the program is executed in the CPU is suitable for carrying out the two methods described above.

The computer program can be integrated into an already existing actuation electronics system using a simple configuration and can be used to control the fuel pump or its electric motor.

For this purpose, a computer program product having program code is provided, the program code being stored on a computer-readable data storage medium, to carry out the method according to any of the method claims when the computer program product is executed in the CPU. The computer program product can also be integrated into the pump control unit 8 as a retrofit option.

Although exemplary embodiments have been explained in the above description, it should be noted that numerous modifications are possible. Furthermore, it should be noted that the exemplary embodiments are merely examples which are not intended to limit the scope of protection, the applications and the structure in any way. Instead, the above description gives a person skilled in the art a guideline for the implementation of at least one exemplary embodiment, wherein various changes may be made, especially with regard to the function and arrangement of the component parts described, without departing from the scope of protection as apparent from the claims and combinations of features equivalent thereto.

The invention claimed is:

1. A method for calibrating a fuel pump (12) for use in a fuel supply system (2) of a device equipped with an internal combustion engine, wherein the method comprises:

under defined conditions, at least partially actively shutting off of a fuel-conducting point (26, 20*b*) of a feed line of the fuel supply system (2) downstream of the fuel pump (12), so as to at least reduce a flow of fuel to the internal combustion engine (28), so as to determine an inflection point of a parameter profile (i, n) representative of a component tolerance and a state of wear of the fuel pump, by incrementally increasing, in steps, a rotational speed n of a fuel pump motor so as to increase a pressure upstream of the shut-off fuel-conducting point (26, 20*b*) while simultaneously determining a phase current i that occurs in the fuel pump motor, wherein the rotational speed is increased until a valve (24, 36) of the fuel supply system (2) opens (OP=opening point) so as to reduce the pressure, wherein the individual rotational speed stages are assigned a determined value for the phase current i, and by approximating, using a graphical determination, and without using a pressure sensor, a first set of value pairs (i, n) below the inflection point (OP) by a first straight line, approximating a second set of value pairs (i, n) above the inflection point (OP) by a second straight line, and determining an intersection point between the two straight lines, wherein the intersection point corresponds to the inflection point (OP) which corresponds to the opening time (OP) of the valve (24, 36), wherein a rotational speed $n_{OP}$ is assigned to the intersection point;

determining, at a first time ($t_1$), a first inflection point ($OP_n$) as a reference point for a non-worn fuel pump (12), and determining, at a second, later time ($t_2$), a second inflection point ($OP_v$) corresponding to the current state of wear of the fuel pump (12); and determining a rotational speed difference Δn between the first inflection point ($OP_n$) and the second inflection point ($OP_v$), wherein, for energy-consumption-optimized actuation of the fuel pump (12) up to the next calibration process which is to be carried out, the rotational speed difference Δn is added as a fixed value to a rotational speed of the fuel pump (12).

2. The method as claimed in claim 1, wherein the rotational speed difference Δn is only used starting from a defined minimum value, for calibrating the fuel pump (12).

3. The method as claimed in claim 2, wherein the method is carried out during an overrun mode of the internal combustion engine or during an operating phase of the internal combustion engine under constant conditions.

4. The method as claimed in claim 3, wherein the rotational speed is increased until the valve (24, 36) of the low-pressure part (30) of the fuel supply system (2) opens so as to reduce the pressure.

5. The method as claimed in claim 4, wherein the valve (24, 36) of a fuel-conducting return line of the low-pressure part (30) opens so as to reduce the pressure.

6. The method as claimed in claim 5, wherein the method is carried out at regular intervals.

7. The method as claimed in claim 6, wherein the method is carried out after a definable number of operating hours of the device or a definable kilometrage status of the vehicle.

8. The method as claimed in claim 7, wherein the method is first carried out after a first number of operating hours of 1 to 3 hours (h) or a first kilometrage status of 20 to 100 km and after that at intervals which respectively correspond to a multiple of the first number of operating hours or of the kilometrage status.

9. The method as claimed in claim 8, wherein the method is then carried out every 10 to 20 hours or every 500 to 1000 km.

10. The method as claimed in claim 8, wherein the method is then carried out after each refueling process of a fuel tank.

11. The method as claimed in claim 10, wherein the rotational speed is increased at least essentially in the form of rotational speed ramp.

12. The method as claimed in claim 11, wherein the rotational speed n assigned to the first and second inflection points ($OP_n$, $OP_v$) is stored in a non-volatile memory of a system-side control unit (8).

13. A non-transitory computer readable medium storing a computer program that, when executed by a program-controlled processor, causes the processor to perform the method as claimed in claim 1.

14. A fuel supply system for use in a device having an internal combustion engine, comprising:

a low-pressure part (30) having a fuel pump (12) drivable by an electric motor and configured to deliver fuel from a fuel tank (9), a shut-off unit for at least partially or completely actively shutting off a fuel-conducting point (26, 20*b*) in a feed line of the fuel supply system (2) downstream of the fuel pump (12) so as to, under defined conditions, to at least reduce or completely prevent a flow of fuel to the internal combustion engine (28), and at least one control unit (4, 8) configured to perform the method as claimed in claim 1 as modeled by software.

15. The fuel supply system as claimed in claim 14, further comprising a high-pressure part (32) configured to have a fluidic communication connection to the low-pressure part (30).

16. The fuel supply system as claimed in claim 15, wherein the fuel supply system (2) comprises a high-pressure pump (20) configured to connect the low-pressure part (30) to the high-pressure part (32) and configured to form the shut-off unit.

17. The fuel supply system as claimed in claim 16, further comprising a pump control unit (8) having a communication connection to the engine control unit (4).

18. The fuel supply system as claimed in claim 17, wherein the low-pressure part (30) is configured such that in the non-shut-off state of the fuel-conducting point (26, 20*b*) a fuel pressure of up to approximately 3.5 bar can be achieved in the low-pressure part (30) by the fuel pump (12), while in the at least partially or completely shut-off state of the fuel-connecting point (26, 20*b*) a fuel pressure of up to approximately 3.9 bar, at which a valve (24, 36) opens in order to reduce the pressure, can be achieved by the fuel pump (12).

19. The fuel supply system as claimed in claim 18, wherein the valve (24, 36) is assigned to a fuel-conducting return line of the fuel supply system (2).

20. A device having a fuel supply system (2) as claimed in claim 19, the device being one selected from the group consisting of a vehicle and a stationary or mobile power generator.

* * * * *